US007562504B2

(12) United States Patent
Herbst et al.

(10) Patent No.: US 7,562,504 B2
(45) Date of Patent: Jul. 21, 2009

(54) ARCHITECTURAL PANEL FABRICATION SYSTEM

(75) Inventors: Walter M. Herbst, Elk River, MN (US); Michael P. Herbst, Excelsior, MN (US)

(73) Assignee: WMH Consulting, Inc., Excelsior, MN (US)

( * ) Notice: Subject to any disclaimer, the term of this patent is extended or adjusted under 35 U.S.C. 154(b) by 1000 days.

(21) Appl. No.: 10/297,107

(22) PCT Filed: May 30, 2001

(86) PCT No.: PCT/US01/17410

§ 371 (c)(1),
(2), (4) Date: May 12, 2003

(87) PCT Pub. No.: WO01/92654

PCT Pub. Date: Dec. 6, 2001

(65) Prior Publication Data

US 2003/0205009 A1 Nov. 6, 2003

Related U.S. Application Data

(60) Provisional application No. 60/207,925, filed on May 30, 2000.

(51) Int. Cl.
*E04B 2/90* (2006.01)
*E04B 2/96* (2006.01)

(52) U.S. Cl. ..... 52/461; 52/762; 52/464; 52/235; 52/745.1; 52/775; 52/772

(58) Field of Classification Search ..... 52/775, 52/771, 772, 774, 766, 770, 506.05, 468, 52/483.1, 489.1, 460, 273, 282.4, 235, 762, 52/551, 511, 582.1, 212, 204.56, 508, 512, 52/461, 464, 509, 745.1; 403/329, 280, 397; 160/135

See application file for complete search history.

(56) References Cited

U.S. PATENT DOCUMENTS 2,066,205 A * 12/1936 Keating ..... 52/506.09
2,607,971 A * 8/1952 Bedford, Jr. ..... 52/713
2,841,255 A * 7/1958 Kemp ..... 52/395
2,960,734 A * 11/1960 Collins ..... 52/217
3,009,549 A * 11/1961 Miller ..... 52/733.2

(Continued)

FOREIGN PATENT DOCUMENTS

GB 2023703 * 1/1980 ..... 52/775

(Continued)

*Primary Examiner*—Phi Dieu Tran A
(74) *Attorney, Agent, or Firm*—Westman, Champlin & Kelly, P.A.

(57) ABSTRACT

An fabrication system used for mounting a structural member to a surface including an anchor attached to the surface. The anchor has a pair of sidewalls extending substantially perpendicular therefrom and forming an anchor channel with one or more first flanges formed on at least one of the sidewalls facing the anchor channel. The fabrication system also includes a panel frame having a body for insertion into the anchor channel. The body has at least one lateral surface extending substantially perpendicularly therefrom. First and second sidewalls extend from the body to define a frame channel for receiving an edge portion of the structural member. At least one of the first and second sidewalls has a serrated inner face facing the frame channel.

21 Claims, 4 Drawing Sheets

U.S. PATENT DOCUMENTS 3,053,353 A * 9/1962 Miller ..... 52/477
3,057,444 A * 10/1962 Walberg ..... 52/461
3,225,502 A * 12/1965 Hallauer ..... 52/461
3,342,000 A * 9/1967 Cripe ..... 52/468
3,380,210 A * 4/1968 Neal et al. ..... 52/235
3,734,550 A 5/1973 Vance ..... 287/189.36 A
3,858,377 A * 1/1975 Browne et al. ..... 52/775
3,971,075 A * 7/1976 Heinbaugh et al. ..... 52/169.7
3,974,608 A 8/1976 Grearson ..... 52/235
4,015,390 A * 4/1977 Howorth ..... 52/772
4,117,640 A * 10/1978 Vanderstar ..... 52/204.593
4,385,850 A * 5/1983 Bobath ..... 403/205
4,546,584 A 10/1985 Mieyal et al. ..... 52/281
4,592,180 A * 6/1986 Gerritsen ..... 52/203
4,648,231 A * 3/1987 Laroche ..... 52/775
4,672,784 A 6/1987 Pohlar ..... 52/235
4,689,930 A * 9/1987 Menchetti ..... 52/277
4,702,050 A * 10/1987 Giguere ..... 52/202
4,731,960 A * 3/1988 Sease ..... 52/36.6
4,738,065 A 4/1988 Crandell ..... 52/235
4,829,740 A * 5/1989 Hutchison ..... 52/475.1
4,833,858 A * 5/1989 Hutchison ..... 52/475.1
4,840,004 A 6/1989 Ting ..... 52/235
4,845,912 A 7/1989 Baker ..... 52/483
4,870,793 A 10/1989 Tomlinson ..... 52/241
4,899,508 A 2/1990 Biebuyck ..... 52/235
4,982,542 A * 1/1991 Funaki ..... 52/770
5,155,952 A * 10/1992 Herwegh et al. ..... 52/100
5,155,958 A 10/1992 Huff ..... 52/235
5,226,274 A * 7/1993 Sommerstein ..... 52/512
5,245,811 A 9/1993 Knorr ..... 52/481
5,263,292 A * 11/1993 Holland et al. ..... 52/235
5,355,645 A 10/1994 Farag ..... 52/235
5,381,637 A 1/1995 Farag ..... 52/204.595
5,452,552 A 9/1995 Ting ..... 52/235
5,469,683 A * 11/1995 McKenna et al. ..... 52/730.3
5,592,794 A * 1/1997 Tundaun ..... 52/220.7
5,611,185 A 3/1997 Wilz ..... 52/506.07
5,644,878 A * 7/1997 Wehrmann ..... 52/287.1
5,678,383 A 10/1997 Danielewicz ..... 52/775
5,694,729 A 12/1997 Blackburn et al. ..... 52/582.2
5,819,486 A 10/1998 Goodings ..... 52/235
5,893,244 A 4/1999 Magoon ..... 52/235
5,916,100 A 6/1999 Mitchell et al. ..... 52/235
6,035,598 A 3/2000 Sukolics et al. ..... 52/506.08
6,101,777 A * 8/2000 Bodine et al. ..... 52/506.06
6,119,429 A 9/2000 Bifano et al. ..... 52/720.1
6,170,213 B1 * 1/2001 Zarrelli et al. ..... 52/509
6,170,214 B1 * 1/2001 Treister et al. ..... 52/511
6,260,321 B1 * 7/2001 Rudduck ..... 52/474
6,289,646 B1 * 9/2001 Watanabe ..... 52/506.01
6,536,175 B2 * 3/2003 Conterno ..... 52/489.1
6,745,527 B1 * 6/2004 Sherman et al. ..... 52/235
2002/0124514 A1 * 9/2002 Higgins ..... 52/506.06

FOREIGN PATENT DOCUMENTS

GB 2033949 * 5/1980 ..... 52/468

* cited by examiner

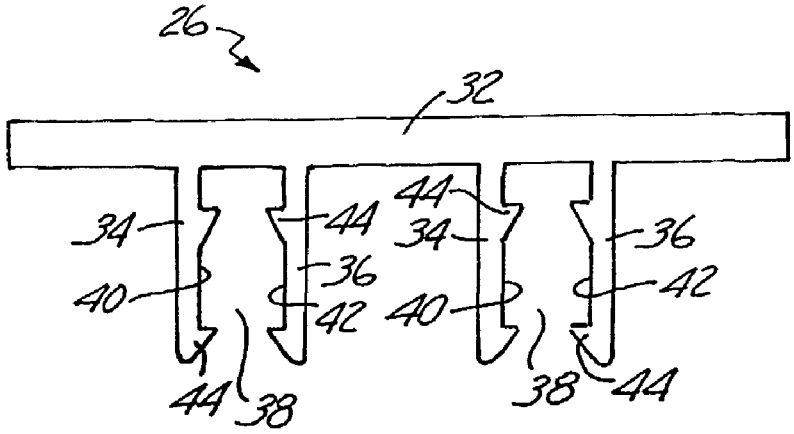
Fig. 3
Fig. 4
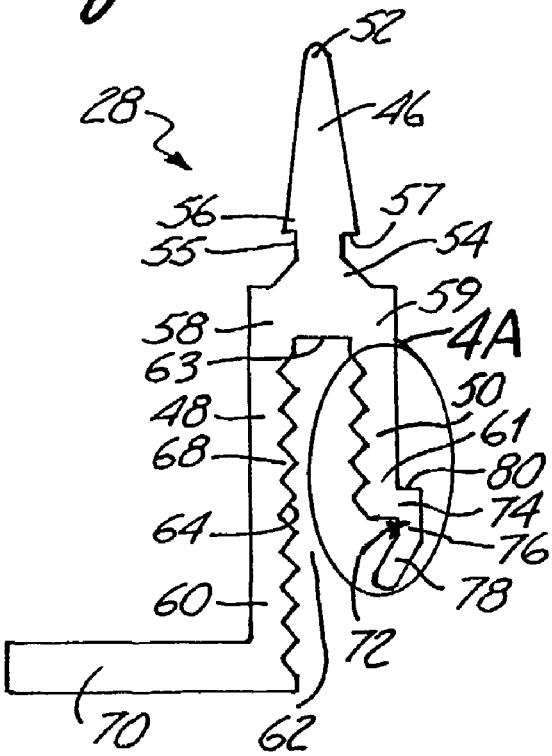
Fig. 4A
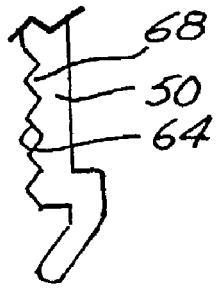

ARCHITECTURAL PANEL FABRICATION SYSTEM

BACKGROUND OF THE INVENTION

The present invention relates to a panel assembly system for attaching architectural wall panels to a building. In particular, the present invention relates to a snap-fit assembly that assures proper alignment of the panels, ease of installation and lower fabrication and installation costs.

For certain types of buildings, panels are often used to cover the exterior walls of the building. The panels are used for aesthetic purposes and can be economically beneficial to the owner. Typically a single panel can be used to cover a large section of the building. Assembly or (framing) systems are commonly used to attach panels (such as composite, aluminum, glass, stone, precast, etc.) to an exterior surface or a support structure of a building. However, the assembly systems currently in use are expensive and require considerable time and labor to install and fabricate.

Generally most assembly systems for attaching panels to a building support utilize a screw-on system or a compression fit system requiring a screw. Systems utilizing screws and other fasteners add labor costs because of additional time required for installation and fabrication. Generally, after the panels are installed within the assembly system, a leveling and alignment process of the panels occurs. The leveling and the alignment process further lengthens the period of time required for proper installation. Furthermore, if the panel needs to be removed due to damage, most assembly systems require the removal of numerous panels to replace the damaged one. This results in increased maintenance costs for maintaining the assembly system.

Existing systems typically allow condensation to drain down the panel and/or the building on which the panel is mounted. The condensation drainage often leads to future leakage and other water damage. Systems that use caulk as a sealant potentially leads to caulk migrating past the face of the panel. The caulk also absorbs contaminants as it ages and causes discoloration and breaking down of the caulk, thereby eliminating the aesthetic benefits of the assembly system. Dry set systems often fail due to improper panel alignment which leads to future leakage within the framing system. Furthermore, current systems use labor intensive methods to seal the corners of the panel or bypass sealing the corners of the panels altogether. The labor intensive methods of sealing lead to increased fabrication costs while not sealing the panels lowers fabrication costs but leads to future assembly system failure.

Many assembly systems utilize a multi-bracket attachment system requiring the use of several different lengths of brackets which have to be aligned at different locations along the building support. This method increases both the labor costs for engineering, fabrication and installation. Also, this method is quite susceptible to misalignment, leading to the panels being installed in an improper plane. Existing assembly systems are often designed for use with a specific type of panel. This limits the versatility of the assembly system and leads to increased costs if different types of panels are used for a single structure. Most systems also utilize aluminum extrusions which are not as resilient or cost effective as other alternatives.

The prior art systems for attaching a panel to a building utilize methods that are labor intensive, have an inconsistency of quality, and have higher maintenance and labor costs. Accordingly, a panel assembly system is needed in the art that is inexpensive and reduces the time and ease of installation and fabrication. The prior art lacks a framing system that is strong, maintains quality, insures proper panel alignment and has low maintenance and labor costs.

BRIEF SUMMARY OF THE INVENTION

The present invention relates to an extruded assembly system for mounting a structure to a member surface. The attachment system includes an anchor attached to the surface. The anchor has a pair of sidewalls extending substantially perpendicular therefrom. The pair of sidewalls form an anchor channel and have one or more first flanges formed on at least one of the sidewalls facing the anchor channel. The attachment system also includes a panel frame having a body. The body has at least one lateral surface extending substantially perpendicularly and the body is inserted into the anchor channel. The body has first and second sidewalls extending from the body. The first and second sidewalls define a frame channel for receiving edge portion of the structural member. At least one of the first and second sidewalls has a serrated inner face facing the frame channel.

In one preferred embodiment of the present invention a gasket is engaged to the second sidewall of the panel frame to form a seal adjacent the structural member. The gasket includes a pair of sidewalls extending substantially perpendicular therefrom. The pair of sidewalls form a gasket channel. One or more third flanges are formed on at least one of the sidewalls for engaging the second sidewall of the panel frame.

BRIEF DESCRIPTION OF THE DRAWINGS

The present invention will be further explained with reference to the drawing figures listed below, wherein like structure is referenced by like numerals throughout the several views.

FIG. 3 is an end view of an anchor used in the inventive assembly system of FIG. 2.

FIG. 4 is an end view of a panel frame used in the inventive assembly system of FIG. 2.

FIG. 4A is an enlarged end view of a portion of the panel frame taken from section 4A of FIG. 4.

While some of the above-identified figures set forth preferred embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

Figure 1:
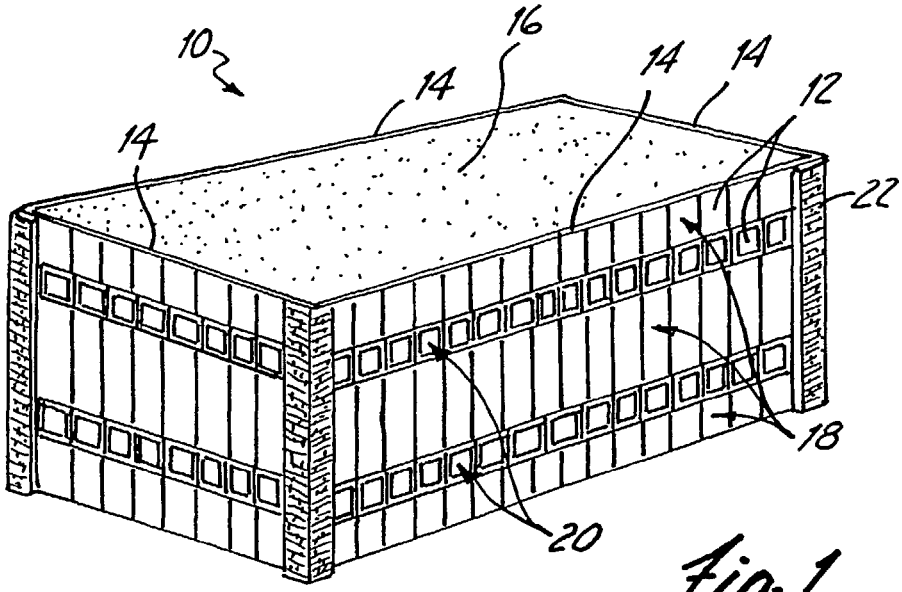
FIG. 1 is a perspective view of a building using an inventive panel assembly system.

FIG. 1 is a perspective view of a building 10 using an inventive assembly system (not shown) to attach structural members 12 to the building 10. The building 10 has at least four support walls 14 and a roof 16. The structural members 12 are attached to the support walls 14 of the building 10. In FIG. 1, the structural members 12 may include composite panels 18, glass windows 20 or other ornamental or functional building components. Also, brick 22 is mounted to the building 10 at the corners. The building 10 is used as an example of a building utilizing the inventive assembly system. Those skilled in the art will recognize that the present invention may be employed on buildings of varying size and shape, as well as in connection with different types of structural members, including composite, aluminum, glass, stone, and precast. The structural members may be attached to other surfaces on the building 10, including the support structure, building support, or a generally vertical surface. Furthermore, the structural members may be attached to any structure, such as bridges or vehicles, and can be used for other forms of construction assemblies.

Figure 2:
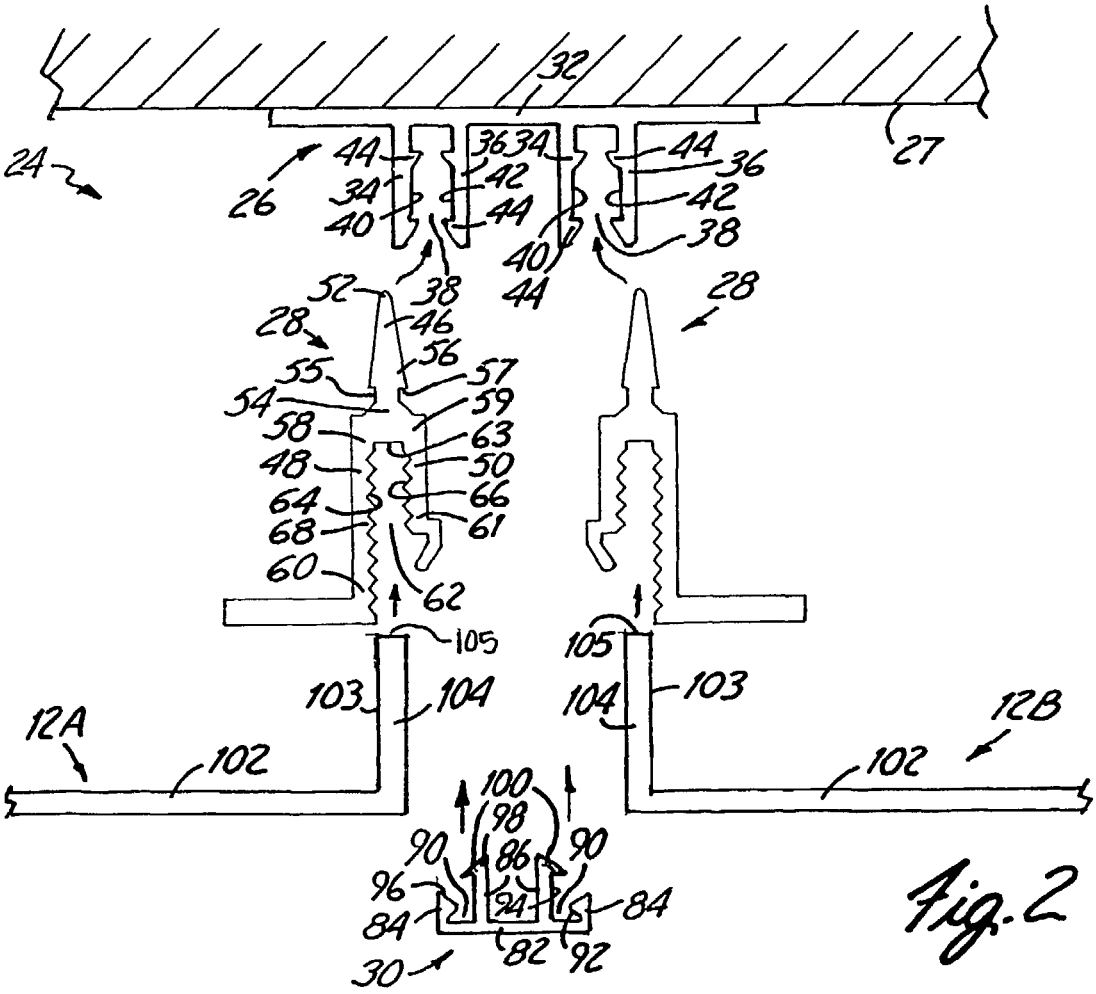
FIG. 2 is an exploded end view of an exemplary embodiment of the assembly system of the present invention.

FIG. 2 shows an exploded end view of an exemplary embodiment of a assembly system 24. The assembly system 24 includes an anchor 26 (secured to a surface 27 of an underlying support structure), at least one panel frame 28, a gasket 30, and the structural member 12. FIGS. 3 and 4 further illustrate the anchor 26 and the panel frame 28, respectively. The anchor 26, the panel frame 28 and the gasket 30 are preferably made of plastic and are formed by an extrusion manufacturing technique. However, those skilled in the art will recognize the assembly system 24 can be extruded using a variety of materials, for example, PVC, aluminum and steel, and the assembly system 24 is adaptable to be installed with different types of materials, such as composite, glass, precast or eface.

The anchor 26 has a base plate 32. A first sidewall 34 and a second sidewall 36 extend from the base plate 32 to form an anchor channel 38. The sidewalls 34 and 36 lie substantially perpendicular to the base plate 32. The first sidewall 34 has an inner face 40 and the second sidewall has an inner face 42. The inner faces 40 and 42 face inward toward the anchor channel 38. First flanges 44 are formed on one or both of the inner faces 40 and 42. The anchor channel 38 receives the panel frame 28. In the exemplary embodiment shown in FIG. 2, two sets of first and second sidewalls 34 and 36 extend from the base plate 32 to form two anchor channels 38. Although FIG. 2 illustrates two first flanges 44 formed on the sidewalls 34 and 36, those skilled in the art will recognize any number of flanges can be formed on the sidewall and that the flanges 44 can be formed on one or both sidewalls.

The panel frame 28 includes a body 46, a first sidewall 48 and a second sidewall 50. The body 46 has a first end 52 and a second end 54. The first end 52 is preferably tapered to form a neck 55 proximate the second end 54. A lateral surface 57 extends perpendicularly from the body 46 of the panel frame 28. One or more second flanges 56 are formed adjacent the neck 55 such that the lateral surface 57 is part of the second flanges 56. When the assembly system 24 is assembled, the body 46 of the panel frame 28 is inserted into the anchor channel 38 of the anchor 26 and the lateral surface 57 of the second flanges 56 engages with the first flanges 44 of the anchor 26, thereby securing the panel frame 28 to the anchor 26 by mechanical engagement. Those skilled in the art will recognize any number of flanges may be formed along the length of the body of the panel frame.

The first sidewall 48 and the second sidewall 50 of the panel frame 28 extend from the second end 54 of the body 46. The sidewalls 48 and 50 preferably lie substantially parallel to the body 46. Each sidewall has a first end 58, 59 and a second end 60, 61. The sidewalls 48 and 50 form a frame channel 62. Preferably, the second end 60 of the first sidewall 48 is further from the body 46 than the second end 61 of the second sidewall 50. The first sidewall 48 has an inner face 64 and the second sidewall 50 has an inner face 66 with the inner faces 64 and 66 facing inwardly toward the frame channel 62. The inner faces 64 and 66 are serrated with a plurality of flanges 68, or teeth, formed on the inner faces 64 and 66. The flanges 68 preferably lie along the entire length of the sidewalls 48 and 50. When the assembly system 24 is assembled, the structural member 12 is inserted into the frame channel 62 of the panel frame 28. The flanges 68 grip the structural member 12 to hold the structural member 12 within the frame channel 62. FIG. 4A shows an enlarged end view of the second sidewall 50 of the panel frame 28 with the flanges 68 along the inner face 66. Although FIG. 2 shows serration on the first and second sidewalls 48 and 50, those skilled in the art will recognize the flanges 68 can be formed on one or both sidewalls.

As seen in FIG. 4, a panel flange 70 extends from the second end 60 of the first sidewall 48. The panel flange 70 lies substantially perpendicular to the first sidewall 48 and extends away from the frame channel 62. A gasket seat 72 extends from the second end 61 of the second sidewall 50 and away from the frame channel 62. The gasket seat 72 includes a shoulder 74, an upper arm 76 and a lower arm 78. The shoulder 74 is attached to the second end 61 of the second sidewall 50. The shoulder 74 extends away from the frame channel 62 and lies substantially perpendicular to the second sidewall 50. A ledge 80 is formed on the shoulder 74. The upper arm 76 is attached to the shoulder 74. The upper arm 76 extends away from the body 46 and lies substantially parallel to the first sidewall 48. The lower arm 78 is attached to the upper arm 76. The lower arm 78 extends at an acute angle from the upper arm 76 towards the second end 60 of the first sidewall 48.

As seen in FIG. 2, the gasket 30 includes a base plate 82, a first sidewall 84 and a second sidewall 86. The first sidewall 84 is attached one end of the base plate 82. The first sidewall 84 extends from the base plate 82 and lies substantially perpendicular to the base plate 82. The second sidewall 86 is attached to the base plate 82. The second sidewall 86 extends from the base plate 82 and lies substantially perpendicular to the base plate 82. The first and second sidewall 84 and 86 form a gasket channel 90. In the exemplary embodiment of the assembly system 24 shown in FIG. 2, two sets of first and second sidewalls 84 and 86 extend from the base plate 82 to form two gasket channels 90.

The first sidewall 84 has an inner face 92 and the second sidewall 86 has an inner face 94. The inner faces 92 and 94 face inward towards the gasket channel 90. The first sidewall 84 has an end 96 opposite the base plate 82 and the end 96 is tapered. The second sidewall 86 has an end 98 opposite the base plate 82 and the end 98 is tapered. A third flange 100 extends from the end 98 of the second sidewall 86 towards the gasket channel 90. Preferably, the second sidewall 86 has a height greater than a height of the first sidewall 84. When the assembly system 24 is assembled, the third flange 100 of the gasket channel 90 engages the gasket seat 72 of the panel frame 28.

Preferably, the structural member 12 has a body 102 and at least one support edge 104 (see FIG. 2). The structural member 12 is preferably a composite panel. However, two different types of panels may be used within one assembly system. For example, the structural member 12A may be aluminum and the structural member 12B may be glass. The support edge 104 of the structural member 12 extends from one end of the body 102 and has an inner face 103. The support edge 104 lies substantially perpendicular to the body 102. The support edge 104 has a length. Preferably, the length of the frame channel 62 is the same. Once the assembly system 24 is assembled, the support edge 104 of the structural member 12 is inserted into the frame channel 62. The flanges 68 of the panel frame 28 grip the support edge 104 to hold the structural member 12 in place. An end 105 of the support edge 104 abuts a bottom 63 of the frame channel 62.

Those skilled in the art will recognize that other means may be used to secure the structural member 12 within the frame channel 62 of the panel frame 28. For example, a connector or adapter may replace the support edge 104. The connector is attached to the body of the structural member and the connector is inserted into the frame channel and gripped by the flanges to hold the structural member in place.

Figure 5:
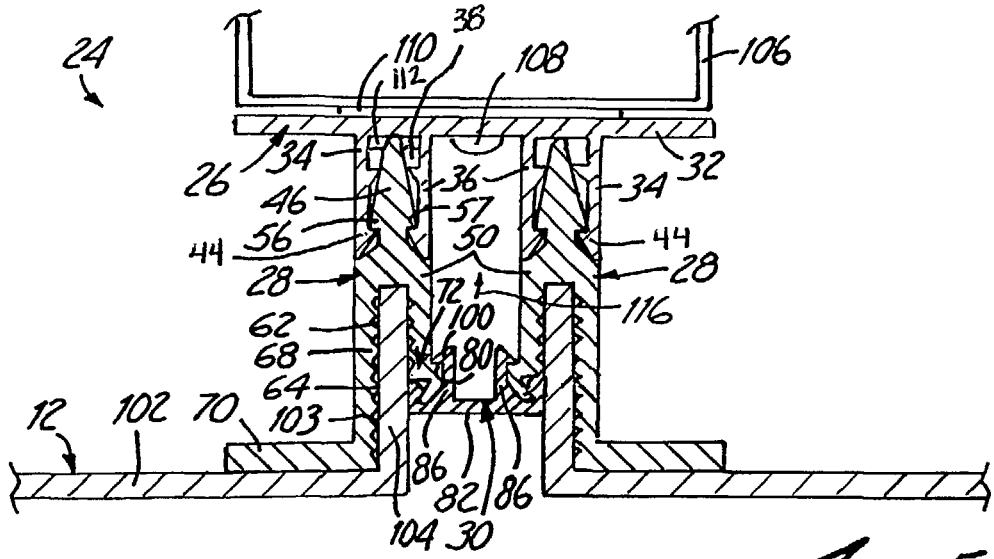
FIG. 5 is an assembled end view of the assembly system of FIG. 2.

FIG. 5 is an assembled end view of the assembly system 24. The anchor 26 is attached to a building support 106 of the building 10. The anchor 26 can be attached to the building support 106 either horizontally or vertically so that once the structural members 12 are attached, the structural members 12 run horizontally or vertically. A fastener 108 (such as a screw, bolt, rivet, etc.) is used to attach the base plate 32 of the anchor 26 to the building support 106. An adhesive 110 is used in the exemplary embodiment around the fastener 108 to help secure the anchor 26 to the building support 106. Those skilled in the art will recognize the assembly system 24 can be attached in other ways, and to other surfaces such as the exterior wall of the building or any vertical surface.

One panel frame 28 is secured within each anchor channel 38. The body 46 of the panel frame 28 is inserted into the anchor channel 38. The first flanges 44 of the anchor 26 engage the lateral surface 57 of the second flanges 56 of the body 46 to secure the panel frame 28 within the anchor channel 38. An adhesive 112, preferably a silicone bead, is deposited within the anchor channel 38 to help the panel frame 28 to anchor 26.

The frame channel 62 receives the support edge 104 of the structural member 12. The flanges 68 of the sidewalls 48 and 50 grip the structural member 12 to secure the structural member 12 within the frame channel 62. Once the structural member 12 is secured within the frame channel 62, the inner face 64 of the panel frame 28 abuts the inner face 103 of the edge 104 of the structural member 12. In the exemplary embodiment shown in FIG. 5, two adjacent panel frames 28 are mounted, although other embodiments exist for the anchor allowing any number of panel frames to be used. Preferably, the two structural members 12 secured by the panel frames 28 extend in opposite directions.

The gasket 30 is preferably used in the assembly system 24 when the anchor 26 has at least two anchor channels 38 securing two panel frames 28. The second sidewalls 50 of the two panel frames 28 face each other. The gasket 30 is attached to the gasket seat 72 on each second sidewall 50. The gasket channels 90 of the gasket 30 engage the ledge 80 of the gasket seat 72 on the panel frame 28. The third flange 100 on the second sidewall 86 engages the ledge 80 of the gasket seat 72. The gasket seat 72 is secured within the gasket channel 90 to secure the gasket 30 to the panel frame 28. An adhesive, preferably a silicone bead, is placed in each gasket channel 90 to help secure the gasket 30 to the panel frame 28 and create a moisture seal adjacent the structural members.

As seen in FIG. 5, The assembled assembly system 24 forms an inner cavity 116. The cavity 116 is formed by the base plate 32 of the anchor 26, the second sidewalls 36 of the anchor 26, the second sidewalls 50 of the panel frame 28, the second sidewalls 86 of the gasket 30 and the base plate 82 of the gasket 30. Condensation which may collect under the structural members 12 travels through the cavity 116. The cavity 116 prevents moisture and condensation from traveling along the front or the rear of the structural members 12.

Figure 6:
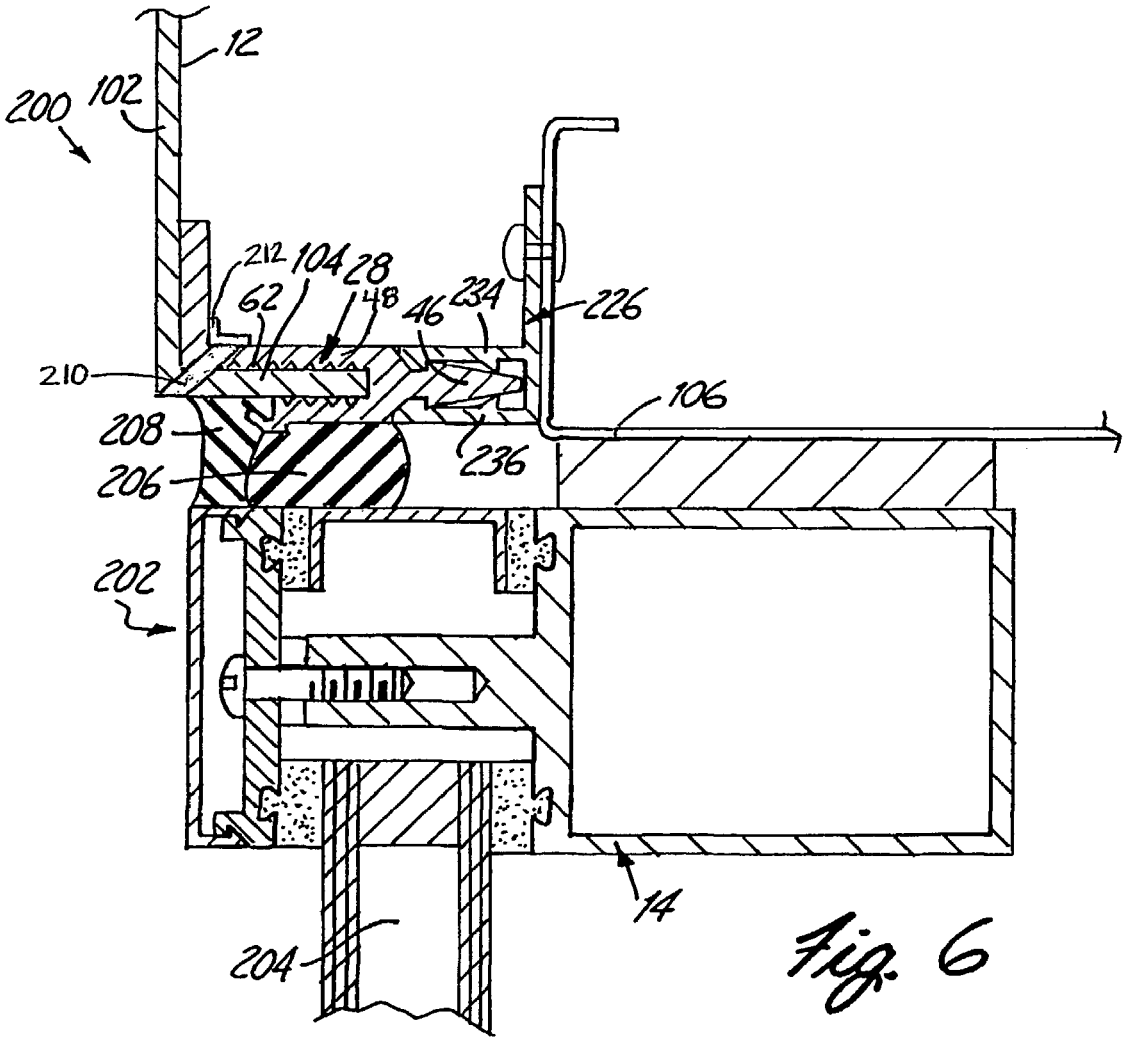
FIG. 6 is an assembled end view of a second exemplary embodiment of the assembly system of the present invention.

FIG. 6 is an assembled end view of another exemplary embodiment of an inventive assembly system 200. The assembly system 200 is used in conjunction with the coupling of different facade or structural materials, such as a panel system and a window wall system 202. The window wall system 202 preferably holds a glass wall 204 and attaches to the support wall 14 of the building 10. Although the window wall system 202 is used as an example in FIG. 6, those skilled in the art will recognize that other structural members may be used in conjunction with the assembly system 200.

The assembly system 200 includes an anchor 226, the panel frame 28 and the structural member 12. The anchor 226 has one anchor channel 238 formed by the first and second sidewalls 234 and 236. The body 46 of the panel frame 28 is inserted into the anchor channel 238 and snap-fit into position. The support edge 104 of the structural member 12 is secured within the frame channel 62. Preferably, a single structural member 12 is used in the assembly system 200, with the anchor 226 attached as discussed above.

Once the assembly system 200 is assembled, the assembly system is attached to the window wall system 202. An adhesive ball 206 secures the window wall system 202 to the assembly system 200. In the exemplary embodiment, the window wall system 202 is attached to the second sidewall 50 of the panel frame 28. Caulk 208 is used to provide a moisture seal between the assembly system 200 and the window wall system 202. A weep hole 210 is formed in the assembly system 200 and provides a gutter system to prevent the drainage of condensation on the face of the structural member 12. The weep hole extends through the first sidewall 48 of the panel frame 28 and the support edge 104 of the panel 12. A screen 212 is placed over one end of the weep hole 210 to prevent insects or other debris from passing through the weep hole 210.

Figure 7A:
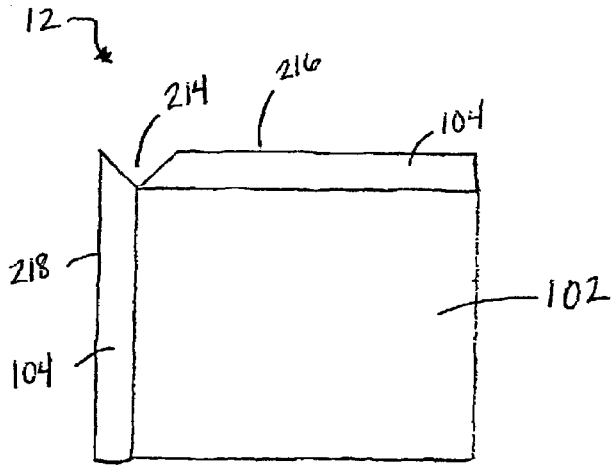
FIG. 7A is a top view of a structural member 12 prior to assembly.

FIG. 7A is a top view of the structural member 12 in a flat position. One process for forming the structural member having the body 102 and at least one support edge 104 is a folding method to create an envelope pan corner. A notch 214 is formed along one edge of the structural member 12 proximate a corner of the structural member between a first edge 216 and a second edge 218. The notch is preferably triangular shaped.

Figure 7B:
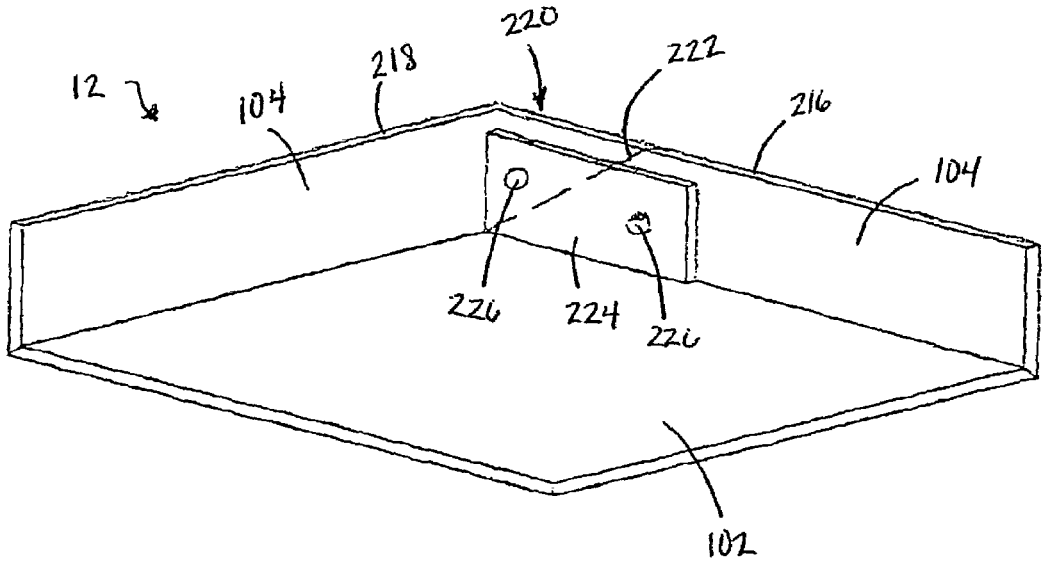
FIG. 7B is a perspective view of a folded structural member for use in the inventive assembly system.

FIG. 7B shows a folded structural member 12 forming an envelope pan corner 220. Both edges 216 and 218 are folded substantially 90 degrees to form the support edge 104. The ends of each edge meet to form a seam 222 along one support edge 104. Moving the seam 222 of the structural member 12 from the corners of the structural member provides greater strength, and results in less likelihood of water penetration and a sharper profile at the corners. In addition, a plate 224 may be fastened to the support edge 104 with a fastener 226 (preferably a rivet). The plate provides support and strength and prevents water penetration. Once the structural member 12 is folded, the support edge 104 is inserted into the frame channel 62 of the panel frame 28.

The assembly system of the present invention insures proper alignment of structural members on a building. The anchor is preferably pre-located and pre-positioned on the building prior to assembling the assembly system and inserting the structural member. Pre-positioning ensures proper location of the anchor, and thus of the assembly system, prior to panel installation. Since the structural members are secured to the panel frames, no post-assembly alignment is necessary. The use of the panel frame set within the anchor provides a properly positioned frame channel for receiving the structural member. Once the structural members are inserted within the frame channel of the panel frame the corners of the panel are automatically aligned and the panel is square on the building. The panel flange provides another means for insuring the structural member is properly aligned within the panel frame. The snap-fit assembled assembly system ensures proper plane of the structural member once assembled and mounted to the building. Pre-location of the anchor reduces installation time and labor costs.

The use of flanges within the anchor channel and the gasket channel, including the serrated frame channel, allows the assembly system parts to be snap-fit into position. The components of the assembly system do not require pop rivets or screws, a backup plate, an attachment bracket or drill holes to assemble the assembly system. The flanged channels eliminate the requirement for multi-sized panel clips and mechanical screw fasteners, thereby allowing easy and quick installation to reduce labor time and costs. The flanged channels provide non-mechanically applied snap-in connection between the components of the assembly system, in particular the panel frame and the anchor.

The length of the anchor channel and the length of the panel frame can be adjusted to meet various installation requirements e.g., may be as long as edge support of structural member. Furthermore, the anchor, the panel frame and the gasket of the assembly system may have a length that runs the entire height of the building or the structural member such that a single assembly system is used for each structural member. Or multiple anchors, panel frames and gaskets running the entire building may be used to attach a single structural member of the building.

The gasket seat of the panel frame provides a proper lock to prevent migration of the gasket. The gasket provides a moisture seal for the assembly system. In particular, the cavity allows an area for moisture and condensation to travel without traveling along the panel or the building. The cavity acts as a buffer system for moisture to be contained within the cavity and not on the face of the panel or the building. This eliminates any discoloring on the panel surface due to exterior drainage. The gasket is preferably formed from a flexible material (e.g., silicone) and can thus be rolled into place and snap-fit into position within the assembly system. The gasket clips onto its respective gasket seat and locks into place. The ability to quickly install the gasket reduces labor costs at the time of installation and speeds up the installation process. The adhesive is applied within the gasket channel to provide further adhesion and act as a sealant. The gasket and the adhesive further provide improved and proper adhesive seal control. The use of the gasket and the adhesive in combination keeps the gasket in position and eliminates discoloring problems due to pollutants and migration of moisture past the face of the structural member. The adhesive applied within the anchor channel also provides a moisture seal.

The anchor and panel frame of the assembly system are preferably made of a high density PVC. The PVC material allows for more resiliency and flexibility of the assembly system. The assembly system will absorb the stress due to expansion and contraction off the panel joints. Thus, pillowing and/or buckling of the surface of the structural member will be reduced. In addition, the PVC material is lighter than aluminum, thus reducing the weight of the assembly system. The high density PVC material provides high impact resistance, proper thermal break, resiliency for locking positions and prevents bowing at the panel face.

A significant advantage of the inventive assembly system is a damaged panel may be removed individually. The ability to remove panels or individually from the assembly system reduces maintenance costs for the building. Overall, the ease of installation at a construction site allows for reduced labor and quicker installation times. Also, potential damage to panels may be reduced because lengthy storage on site is no longer necessary.

Although the present invention has been described with reference to preferred embodiments, workers skilled in the art will recognize that changes may be made in form and detail without departing from the spirit and scope of the invention.

The invention claimed is:

1. An assembly system for mounting a panel to a support structure surface, the assembly system comprising:

an anchor configured to attach to a support structure surface and having a pair of sidewalls extending substantially perpendicular therefrom, the pair of sidewalls forming an anchor channel and having one or more first flanges formed on each of the sidewalls facing the anchor channel;

a panel having an edge portion;

a panel frame having a body adapted for insertion into the anchor channel, the body having at least one lateral surface extending substantially perpendicularly therefrom, the body having first and second sidewalls extending from the body to define a frame channel for removably receiving the edge portion of the panel and at least one of the first and second sidewalls having a serrated inner face facing the frame channel, wherein the frame channel is substantially parallel with and spaced apart from the anchor channel; and a gasket engaged to the second sidewall of the panel frame to form a seal adjacent the panel, wherein the gasket includes a pair of sidewalls extending substantially perpendicular therefrom, the pair of sidewalls forms a gasket channel and one or more gasket flanges are formed on at least one of the sidewalls for engaging the second sidewall of the panel frame, wherein the gasket channel is a first gasket channel and the gasket has an additional pair of sidewalls thereon which form a second gasket channel spaced from and parallel to the first gasket channel.

2. The assembly system of claim 1 wherein the anchor channel is a first anchor channel and the anchor has an additional pair of sidewalls thereon which form a second anchor channel spaced from and parallel to the first anchor channel.

3. The assembly system of claim 1 wherein the lateral surface on the body of the panel frame engage the first flanges within the anchor channel.

4. The assembly system of claim 1 wherein an adhesive is applied to further secure the panel frame to the anchor.

5. The assembly system of claim 1 wherein the panel frame includes a panel flange extending substantially perpendicular from the first sidewall away from the frame channel.

6. The assembly system of claim 5 wherein the panel flange abuts the panel when the panel is secured within the frame channel.

7. The assembly system of claim 1 wherein an adhesive is applied within the first gasket channel to further secure the gasket to the second sidewall and form the seal.

8. An assembly system for mounting a structural member to a support structure surface, the assembly system comprising:

an anchor configured to attach to a support structure surface and having a pair of sidewalls extending substantially perpendicular therefrom, the pair of sidewalls forming an anchor channel and having one or more first flanges formed on each of the sidewalls facing the anchor channel;

a structural member having an edge portion;

a panel frame having a body adapted for insertion into the anchor channel, the body having at least one lateral surface extending substantially perpendicularly therefrom, the body having first and second sidewalls extending from the body to define a frame channel for removably receiving the edge portion of the structural member and at least one of the first and second sidewalls having a serrated inner face facing the frame channel, wherein the frame channel is substantially parallel with and spaced apart from the anchor channel, wherein the panel frame includes a gasket seat extending from the second sidewall away from the frame channel, and wherein the gasket seat further comprises:

a shoulder extending substantially perpendicular from the second sidewall of the panel frame and away from the frame channel, the shoulder forming a ledge;

an upper arm extending substantially perpendicular from the shoulder and away from the body; and a lower arm extending at an acute angle from the upper arm toward the first sidewall; and a gasket engaged to the second sidewall of the panel frame to form a seal adjacent the structural member, wherein the gasket includes a pair of sidewalls extending substantially perpendicular therefrom, the pair of sidewalls forms a gasket channel and one or more gasket flanges are formed on at least one of the sidewalls for engaging the second sidewall of the panel frame.

9. The assembly system of claim 8, wherein the gasket engages the ledge of the gasket seat to form the seal.

10. The assembly system of claim 1 wherein the first sidewall of the panel frame is higher than the second sidewall of the panel frame.

11. An assembly system for mounting structural members to a support structure surface, the assembly system comprising:

an anchor configured to attach to a support structure surface and having a pair of sidewalls extending substantially perpendicular therefrom, the pair of sidewalls forming a first anchor channel and the anchor having an additional pair of sidewalls thereon which form a second anchor channel spaced from and parallel to the first anchor channel, and having one or more first flanges formed on each of the sidewalls facing each anchor channel;

a first structural member having an edge portion;

a first panel frame having a body adapted for insertion into the first anchor channel, the body having at least one lateral surface extending substantially perpendicularly therefrom, the body having first and second sidewalls extending from the body to define a frame channel for receiving the edge portion of the first structural member and at least one of the first and second sidewalls having a serrated inner face facing the frame channel, wherein the frame channel is substantially parallel with and spaced apart from the first anchor channel;

a second structural member having an edge portion;

a second panel frame having a body adapted for insertion into the second anchor channel, the body of the second panel frame having first and second sidewalls extending from said body to define a frame channel for receiving the edge portion of the second structural member;

a gasket having two pairs of sidewalls extending substantially perpendicular therefrom, the pairs of sidewalls form a first gasket channel and a second gasket channel, one or more gasket flanges are formed on at least one of the sidewalls of each pair wherein the first gasket channel engages the second sidewall of the first panel frame and the second gasket channel engages the second sidewall of the second panel frame to form a seal adjacent the structural members; and an adhesive is disposed within the first and second gasket channels to further secure the gasket to the second sidewalls and form the seal.

12. A method for attaching a structural member having an edge portion to a surface, the method comprising:

providing an anchor having a pair of sidewalls extending substantially perpendicular therefrom, the pair of sidewalls forming an anchor channel and having one or more first flanges formed on at least one sidewall facing the anchor channel;

securing the anchor to the surface;

providing a panel frame having a body, the body having at least one lateral surface extending substantially perpendicularly therefrom, the body having first and second sidewalls extending from the body to define a frame channel and at least one of the first and second sidewalls has a serrated inner face facing the frame channel, wherein the frame channel is substantially parallel with and spaced apart from the anchor channel;

securing the panel frame to the anchor wherein the body of the panel frame is inserted into the anchor channel of the anchor;

securing the edge portion of the structural member within the frame channel of the panel frame wherein the edge portion is removably engaged by the serrated face; and engaging a gasket to the second sidewall of the panel frame to form a seal adjacent the structural member;

wherein the second sidewall of the panel frame includes a gasket seat comprising:

a shoulder extending substantially perpendicular from the second sidewall of the panel frame and away from the second sidewall of the panel frame and away from the frame channel, the shoulder forming a ledge;

an upper arm extending substantially perpendicular from the shoulder and away from the body; and a lower arm extending at an acute angle from the upper arm toward the first sidewall of the panel frame.

13. The method of claim 12 wherein the anchor channel is a first channel and the anchor has an additional pair of sidewalls thereon which form a second anchor channel spaced from and parallel to the first anchor channel.

14. The method of claim 12 wherein the securing the panel frame step comprises engaging the lateral surface on the body of the panel frame with the first flanges within the anchor channel.

15. The method of claim 12, and further comprising:

disposing an adhesive within the anchor channel to secure the panel frame to the anchor.

16. The method of claim 12, and further comprising:

disposing an adhesive between the gasket and the panel frame prior to engaging the gasket to the second sidewall of the panel frame.

17. The method of claim 12, and further comprising:

abutting the gasket against the ledge of the gasket seat when the gasket is engaged with the panel frame.

18. The method of claim 12 wherein the structural member has a support edge extending from the structural member, and further comprising:

securing the support edge within the frame channel of the panel frame.

19. The method of claim 12 wherein a panel flange extends substantially perpendicular from the first sidewall of the panel frame and away from the frame channel.

20. The method of claim 19, and further comprising:

abutting the panel flange against the structural member when the structural member is secured within the frame channel of the panel frame.

21. A method for attaching two panels, each having an edge portion, to a support structure surface, the method comprising:

providing an anchor having at least two pairs of sidewalls extending substantially perpendicular therefrom, one pair of sidewalls forming a first anchor channel and the other pair of sidewalls forming a second anchor channel and the anchor having one or more first flanges formed on at least one sidewall of each pair of sidewalls, the flanges facing the anchor channel;

securing the anchor to a support structure surface;

providing a first panel frame and a second panel frame, each of the panel frames having a body, the body having at least one lateral surface extending substantially perpendicularly therefrom, the body has first and second sidewalls extending from the body to define a frame channel and at least one of the first and second sidewalls has a serrated inner face facing the frame channel;

securing the first panel frame within the first anchor channel and securing the second panel frame within the second anchor channel wherein the lateral surface of the panel frame engages the first flanges within the anchor channel;

securing the edge portion of a first one of the panels within the frame channel of the first panel frame wherein said edge portion is engaged by the serrated face facing said frame channel;

securing the edge portion of the second one of the panels within the frame channel of the second panel frame wherein said edge portion is engaged by the serrated face facing said frame channel;

providing a gasket having two pairs of sidewalls extending substantially perpendicular therefrom, one pair of sidewalls forming a first gasket channel and the other pair of sidewalls forming a second gasket channel, and one or more gasket flanges are formed on at least one of the sidewalls of each pair; and engaging the gasket to the panel frames wherein the first gasket channel engages the second sidewall of the first panel frame and the second gasket channel engages the second sidewall of the second panel frame to form a seal adjacent the two panels.

* * * * *